US006939212B1

(12) United States Patent
Pham

(10) Patent No.: US 6,939,212 B1
(45) Date of Patent: Sep. 6, 2005

(54) POROUS MATERIAL AIR BEARING PLATEN FOR CHEMICAL MECHANICAL PLANARIZATION

(75) Inventor: Xuyen Pham, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 251 days.

(21) Appl. No.: 10/029,457

(22) Filed: Dec. 21, 2001

(51) Int. Cl.[7] ..... B24B 41/00
(52) U.S. Cl. ..... 451/340; 451/442; 451/490
(58) Field of Search ..... 451/41, 59, 63, 451/296, 442, 340, 490

(56) References Cited

U.S. PATENT DOCUMENTS

| | | | | |
|---|---|---|---|---|
| 5,558,568 | A | 9/1996 | Talieh et al. | 451/303 |
| 5,593,344 | A | 1/1997 | Weldon et al. | 451/296 |
| 5,692,947 | A | 12/1997 | Talieh et al. | 451/41 |
| 5,722,877 | A | 3/1998 | Meyer et al. | 451/41 |
| 5,800,248 | A | 9/1998 | Pant et al. | 451/41 |
| 5,916,012 | A * | 6/1999 | Pant et al. | 451/41 |
| 5,961,372 | A | 10/1999 | Shendon | 451/41 |
| 5,980,368 | A | 11/1999 | Chang et al. | 451/303 |
| 6,086,456 | A | 7/2000 | Weldon et al. | 451/41 |
| 6,086,464 | A * | 7/2000 | Ulfig et al. | 451/259 |
| 6,135,865 | A * | 10/2000 | Beardsley et al. | 451/285 |
| 6,155,915 | A | 12/2000 | Raeder | 451/285 |
| 6,261,958 | B1 * | 7/2001 | Crevasse et al. | 438/692 |
| 6,267,659 | B1 * | 7/2001 | Chen et al. | 451/533 |
| 6,358,118 | B1 | 3/2002 | Boehm et al. | 451/24 |
| 2002/0102920 | A1 * | 8/2002 | Vogtmann et al. | 451/41 |
| 2002/0142704 | A1 * | 10/2002 | Hu et al. | 451/8 |
| 2003/0114079 | A1 * | 6/2003 | Berkstresser et al. | 451/28 |

FOREIGN PATENT DOCUMENTS

| | | | |
|---|---|---|---|
| EP | 0 706 857 A | 4/1996 | B24B 37/04 |
| EP | 0 914 906 A2 | 5/1999 | B24B 37/04 |
| EP | 0 914 906 A3 | 5/1999 | B24B 37/04 |
| WO | WO 00 25982 A | 5/2000 | B24B 37/04 |

* cited by examiner

*Primary Examiner*—Timothy V. Eley
(74) *Attorney, Agent, or Firm*—Martine Penilla & Gencarella, LLP

(57) ABSTRACT

A platen for use in chemical mechanical planarization (CMP) systems includes a platen plate that has at least one recess defined therein. The at least one recess has an input port formed therein. A porous material is disposed in the at least one recess. The porous material has a porosity sufficient to restrict air flow therethrough so as to reduce an amount of air required for a CMP operation.

21 Claims, 6 Drawing Sheets

POROUS MATERIAL AIR BEARING PLATEN FOR CHEMICAL MECHANICAL PLANARIZATION

BACKGROUND OF THE INVENTION

The present invention relates to chemical mechanical planarization (CMP) techniques and, more particularly, to the efficient, cost effective, and improved CMP operations.

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess material.

A chemical mechanical planarization (CMP) system is typically utilized to polish a wafer as described above. A CMP system typically includes system components for handling and polishing the surface of a wafer. Such components can be, for example, an orbital polishing pad, or a linear belt polishing pad. The pad itself is typically made of a polyurethane material or polyurethane in conjunction with other materials such as, for example a stainless steel belt. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface that is desired to be planarized is substantially smoothed, much like sandpaper may be used to sand wood. The wafer may then be cleaned in a wafer cleaning system.

FIG. 1A shows a linear polishing apparatus 10 which is typically utilized in a CMP system. The linear polishing apparatus 10 polishes away materials on a surface of a semiconductor wafer 16. The material being removed may be a substrate material of the wafer 16 or one or more layers formed on the wafer 16. Such a layer typically includes one or more of any type of material formed or present during a CMP process such as, for example, dielectric materials, silicon nitride, metals (e.g., aluminum and copper), metal alloys, semiconductor materials, etc. Typically, CMP may be utilized to polish the one or more of the layers on the wafer 16 to planarize a surface layer of the wafer 16.

The linear polishing apparatus 10 utilizes a polishing belt 12, which moves linearly in respect to the surface of the wafer 16. The belt 12 is a continuous belt rotating about rollers (or spindles) 20. The rollers are typically driven by a motor so that the rotational motion of the rollers 20 causes the polishing belt 12 to be driven in a linear motion 22 with respect to the wafer 16.

The wafer 16 is held by a wafer carrier 18. The wafer 16 is typically held in position by mechanical retaining ring and/or by vacuum. The wafer carrier positions the wafer atop the polishing belt 12 so that the surface of the wafer 16 comes in contact with a polishing surface of the polishing belt 12.

FIG. 1B shows a side view of the linear polishing apparatus 10. As discussed above in reference to FIG. 1A, the wafer carrier 18 holds the wafer 16 in position over the polishing belt 12 while applying pressure to the polishing belt. The polishing belt 12 is a continuous belt typically made up of a polymer material such as, for example, the IC 1000 made by Rodel, Inc. layered upon a supporting layer. The polishing belt 12 is rotated by the rollers 20 which drives the polishing belt in the linear motion 22 with respect to the wafer 16. In one example, an air bearing platen 24 supports a section of the polishing belt under the region where the wafer 16 is applied. The platen 24 can then be used to apply air against the under surface of the supporting layer. The applied air thus forms a bearing that creates a polishing pressure on the underside of the polishing belt 12 which is applied against the surface of the wafer 16. Unfortunately, because the polishing pressure produced by a typical air bearing with air holes interspersed uniformly throughout the platen typically cannot be controlled very well, the polishing pressure applied by the air bearing to different parts of the wafer 16 generally cannot be separately managed. Hence, conventional air bearings generally do not accurately control wafer polishing on the leading and trailing edges of the wafer 16. In addition, typical air bearing platens utilize a very large amount of air. For example in platens used to in 200 mm wafer CMP operations as much as 100 SCFM of air may be utilized, and in 300 mm wafer CMP operations as much as 200 SCFM of air may be used. As a result, a large source of air must be utilized to be able to provide sufficient air to create the air bearing. Consequently, prior art air bearing platens have a problem of large air consumption.

Therefore, there is a need for an apparatus that overcomes the problems of the prior art by having a platen that improves polishing pressure control and reduces the massive air consumption that typically occurs in prior art CMP systems.

SUMMARY OF THE INVENTION

Broadly speaking, the platen described herein fills these needs by providing an apparatus for independently controlling air pressure above various portions of the air bearing platen during CMP and at the same time reducing air consumption by utilizing porous materials in the platen. The method involves using an improved air bearing platen with strategically utilized air ports underneath porous materials to powerfully control air pressure pushing on certain regions of the polishing pad with greatly reduced air consumption compared to prior art platens. In this way, polishing pressure in different sections of a wafer may be separately controlled which in turn enables precise control of polishing pad deformation during polishing. In addition, the platen reduces problems with large air consumption. It should be appreciated that the present invention can be implemented in numerous ways, including as a process, an apparatus, a system, a device or a method. Several inventive embodiments of the present invention are described below.

In a one embodiment, a platen for use in chemical mechanical planarization (CMP) systems includes a platen plate that has at least one recess defined therein. The at least one recess has an input port formed therein. A porous material is disposed in the at least one recess. The porous material has a porosity sufficient to restrict air flow therethrough so as to reduce an amount of air required for a CMP operation.

In another embodiment, a platen plate has a recess defined in a central region of the platen plate and a plurality of recesses defined in a peripheral region of the platen plate. The recess in the central region and each of the plurality of recesses defined in the peripheral region have an input port therein. The recess defined in the central region and each of the plurality of recesses defined in the peripheral region have an annular shape. The platen plate also includes a plurality of annular sections. One of the annular sections is disposed in the recess defined in the central region of the platen plate and the other of the annular sections are disposed in the plurality of recesses defined in the peripheral region of the platen plate. Each of the plurality of annular sections is comprised of porous material having a porosity sufficient to restrict air flow therethrough so as to reduce an amount of air required for a CMP operation.

In yet another embodiment, a method for supplying air to an underside of a polishing belt in a chemical mechanical planarization (CMP) system includes providing a platen proximate to an underside of a polishing belt. At least a portion of the platen is formed of a porous material having a porosity sufficient to restrict air flow therethrough so as to reduce an amount of air required for a CMP operation. The method also includes flowing air through the porous material to the underside of the polishing belt.

The advantages of the present invention are numerous. Most notably, by creating an apparatus that is configured to control air pressure applied by a platen to a polishing belt while at the same time dramatically reducing air consumption by the platen, various air output regions in certain parts of the platen may be managed together or separately. In this way, the polishing pressure applied by the polishing belt to certain areas of a wafer may be effectively managed thereby optimizing polishing belt profile during CMP operations. Such intelligent management of polishing pressure enables attainment of an optimal wafer polishing profile. In addition, the platen described herein includes a porous material configured to cover the various air output ports within the platen. By placing the porous material over the output regions, air does not flow freely through the porous material thereby decreasing air usage by the platen during the generation of an air bearing in a CMP process. But through consistent application of air pressure applied to the porous material, air pressure desired to create the air bearing for wafer polishing may be attaned. Consequently, the present inventions enable optimal air bearing generation but also consumes much less air than conventional platens.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE INVENTION

Figure 1A:
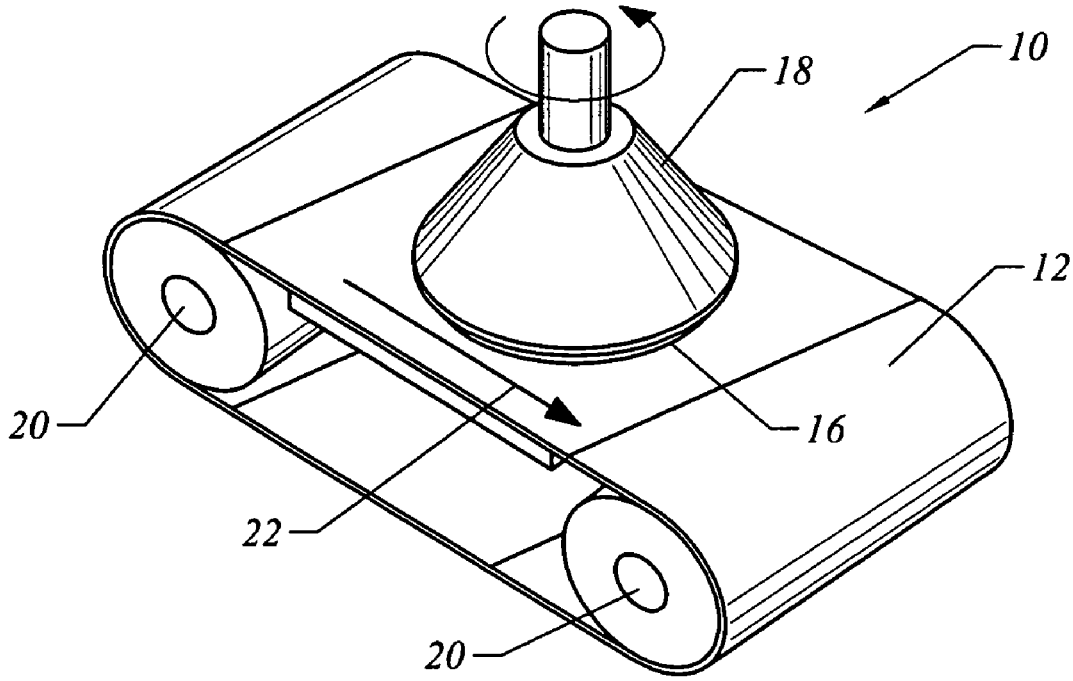
FIG. 1A (Prior Art)
FIG. 1A shows a linear polishing apparatus which is typically utilized in a CMP system.
Figure 1B:
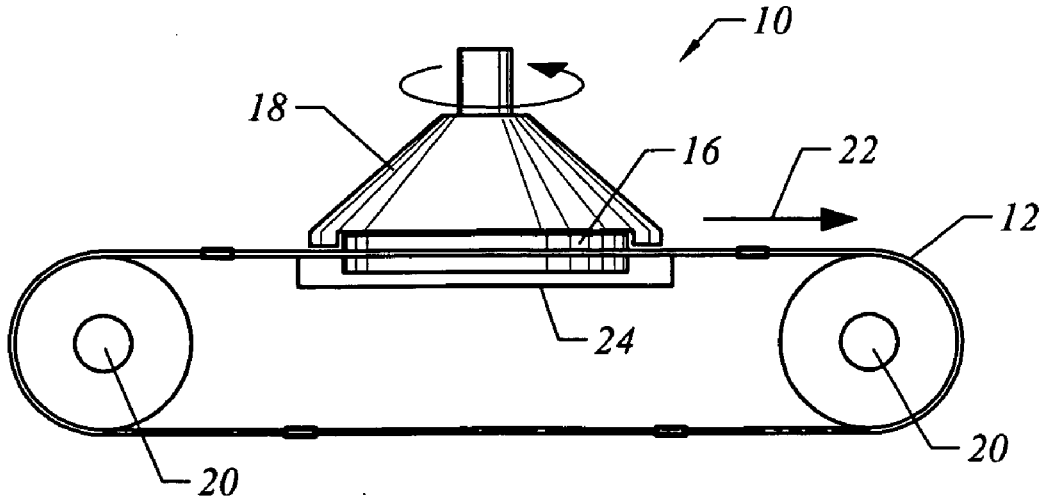
FIG. 1B (Prior Art)
FIG. 1B shows a side view of the linear polishing apparatus.

Several exemplary embodiments of the invention will now be described in detail with reference to the accompanying drawings. FIGS. 1A and 1B are discussed above in the "Background of the Invention" section.

In summary, a platen for use in chemical mechanical planarization includes a platen plate with a plurality of recesses. A porous material is disposed over the recesses so optimal air pressure may be maintained on an underside of a polishing belt during CMP operations without consumption of large amounts of air. The porous material has a porosity sufficient to restrict air flow through it so as to reduce air usage for CMP operations. Therefore, the polishing pressure on wafers may be optimized and air consumption is dramatically reduced.

It should be understood that the platen described herein may be utilized to optimize air usage and to generate optimal air pressure on any suitable polishing pad structure such as, for example, a linear polishing belt. The platen may also be utilized to optimize wafer polishing operations involving any suitable size or type of wafers such as, for example, 200 mm semiconductor wafers, 300 mm semiconductor wafers, etc. The platen therefore enables optimized, more efficient, and more consistent wafer polishing operations in any suitable type of CMP apparatus.

Figure 2A:
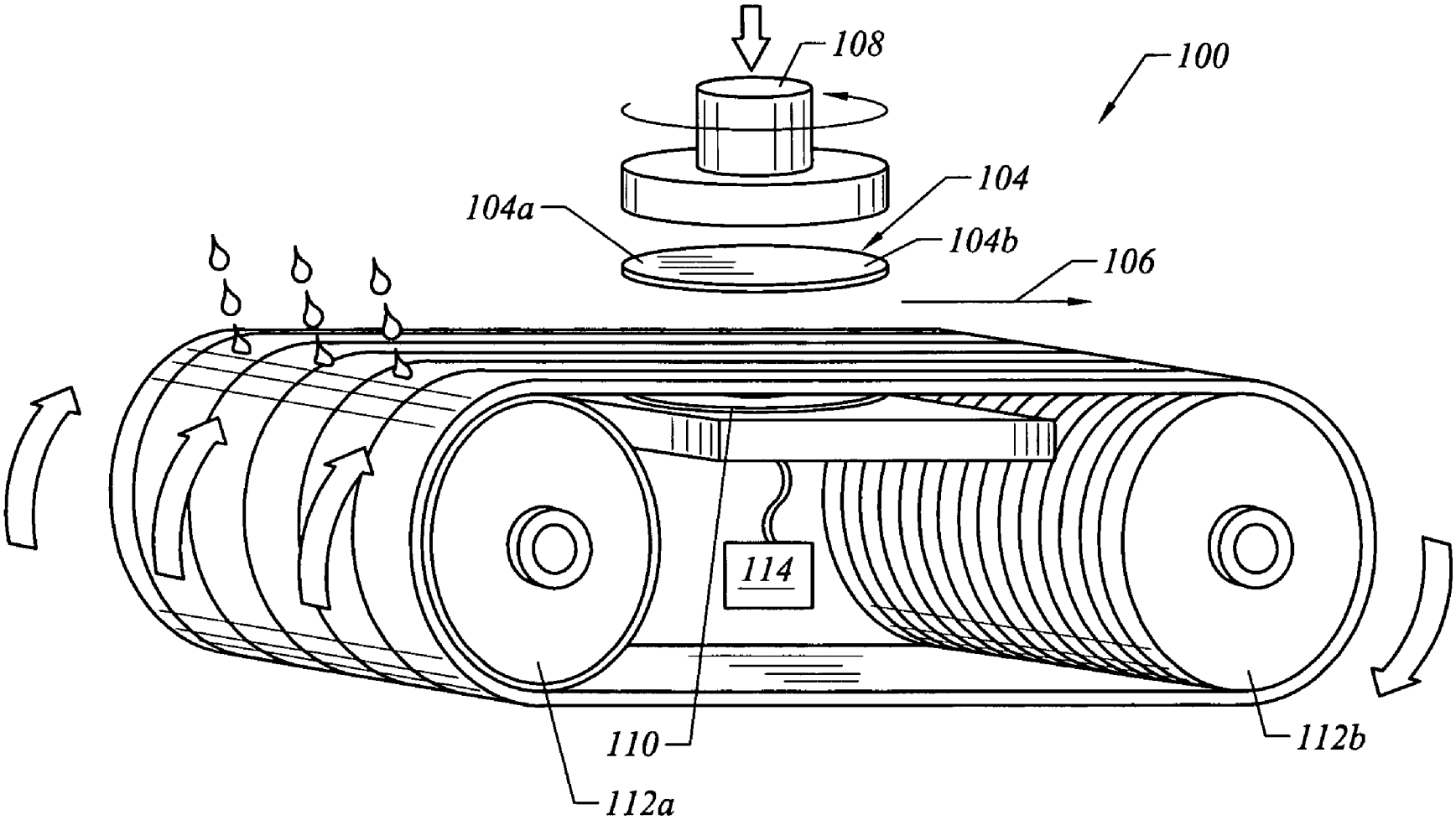
FIG. 2A shows a CMP system according to one embodiment of the present invention.

FIG. 2A shows a CMP system 100 according to one embodiment of the present invention. A polishing head 108 may be used to secure and hold the wafer 104 in place during wafer polishing operations. A polishing belt 102 forms a continuous loop around rotating drums 112*a* and 112*b*. It should be appreciated that the polishing belt 102 may be any suitable type of structure such as, for example, a single layer polishing pad, a polishing pad supported by a stainless steel layer, a multilayer polishing structure (e.g., a polishing pad over a cushioning layer which is in turn over a stainless steel layer). The polishing belt 102, in one embodiment, is a single layer polyurethane polishing pad utilized in linear CMP systems. The polishing belt 102 generally rotates in a direction indicated by a direction 106 at a speed of about 400 feet per minute. Although, this speed does vary depending upon the specific CMP operation. As the belt rotates, polishing slurry may be applied and spread over the surface of the polishing belt 102. A leading edge 104*a* and a trailing edge 104*b* of the wafer 104 are shown. The leading edge 104*a* is a section of the wafer that encounters the polishing belt 102 before the trailing edge 104*b* as the polishing belt rotates in direction 106.

The polishing head 108 may then be used to lower the wafer 104 onto the surface of the rotating polishing belt 102. A platen 110 may support the polishing belt 102 during the polishing process. The platen 110 may utilize any type of bearing such as an air bearing. Air pressure from an air source 114 is inputted into the platen 110 by way of independently controlled air outputs that may be utilized to apply air pressure to an underside of the polishing belt 102 to control the polishing pad profile. The platen 110 may be any size that would enable optimal wafer processing operations. In this manner, the surface of the wafer 104 that is desired to be planarized is substantially smoothed in an even manner.

Figure 3:
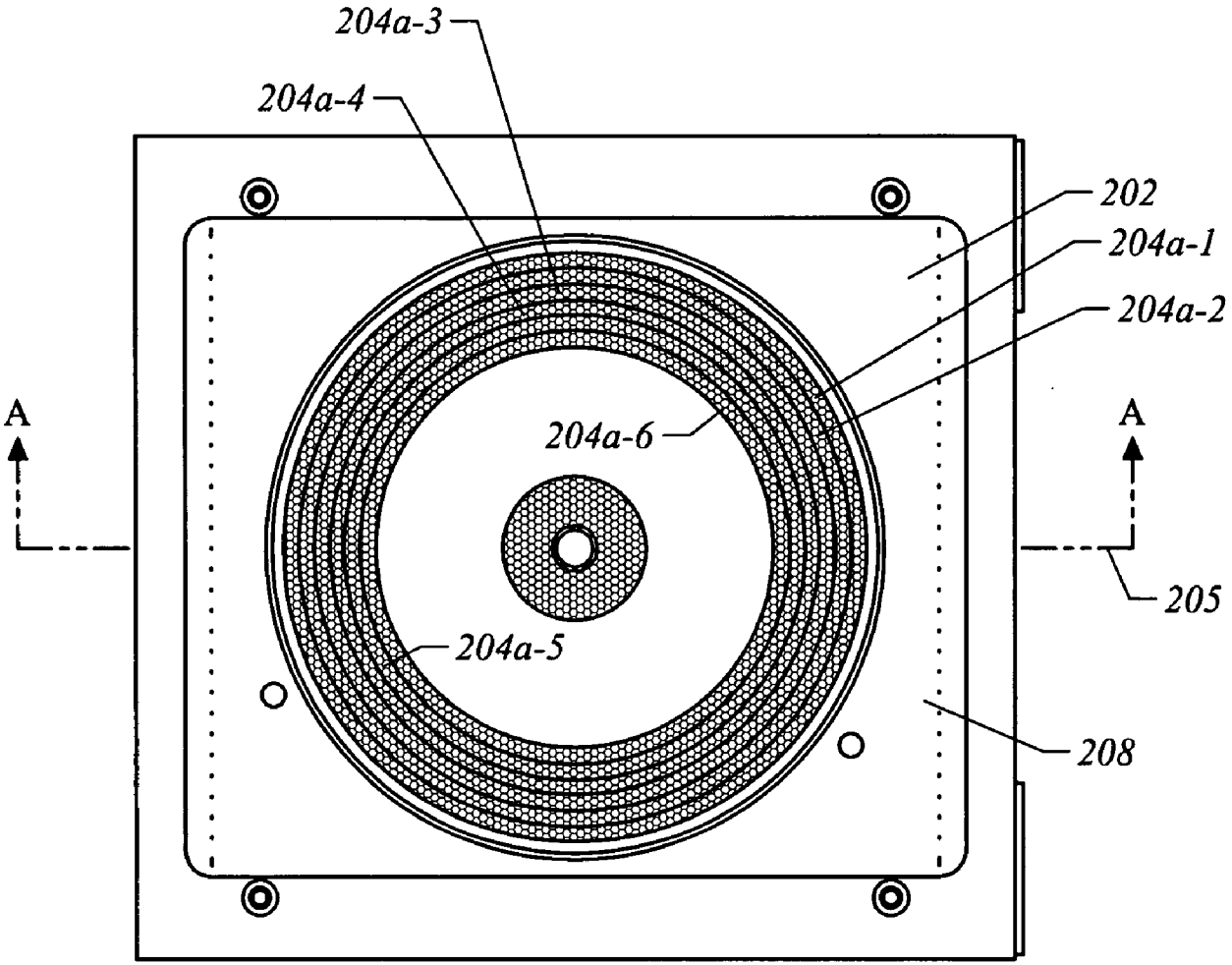
FIG. 3 shows a close-up overhead view of the platen in accordance with one embodiment of the present invention.

In some cases, the CMP operation is used to planarize materials such as copper (or other metals), and in other cases, it may be used to remove layers of dielectric or combinations of dielectric and copper. The rate of planarization may be changed by adjusting the polishing pressure. The polishing rate is generally proportional to the amount of polishing pressure applied to the polishing pad against the platen 110. As shown in FIG. 3, the platen 110 uses air as a bearing; however it should be understood that any other suitable type of fluid or gas may be utilized by the platen 110 to form the bearing between the platen 110 and the polishing belt 102. The air pressure applied by the platen 110 to the polishing belt 102 may also affect the polishing rate of the wafer 104. In one embodiment, a plurality of air pressure regions are generated by a plurality of recesses (shown in FIG. 4) of the platen 110 which may be utilized to output air and adjust the polishing belt profile during CMP operations to provide optimal and consistent wafer polishing. As described in further detail in reference to FIG. 3, a section formed of a porous material is disposed in each of the plurality of recesses to reduce air consumption during air pressure generation. After the desired amount of material is removed from the surface of the wafer 104, the polishing head 108 may be used to raise the wafer 104 off of the polishing belt 102. The wafer 104 is then ready to proceed to a wafer cleaning system.

Figure 2B:
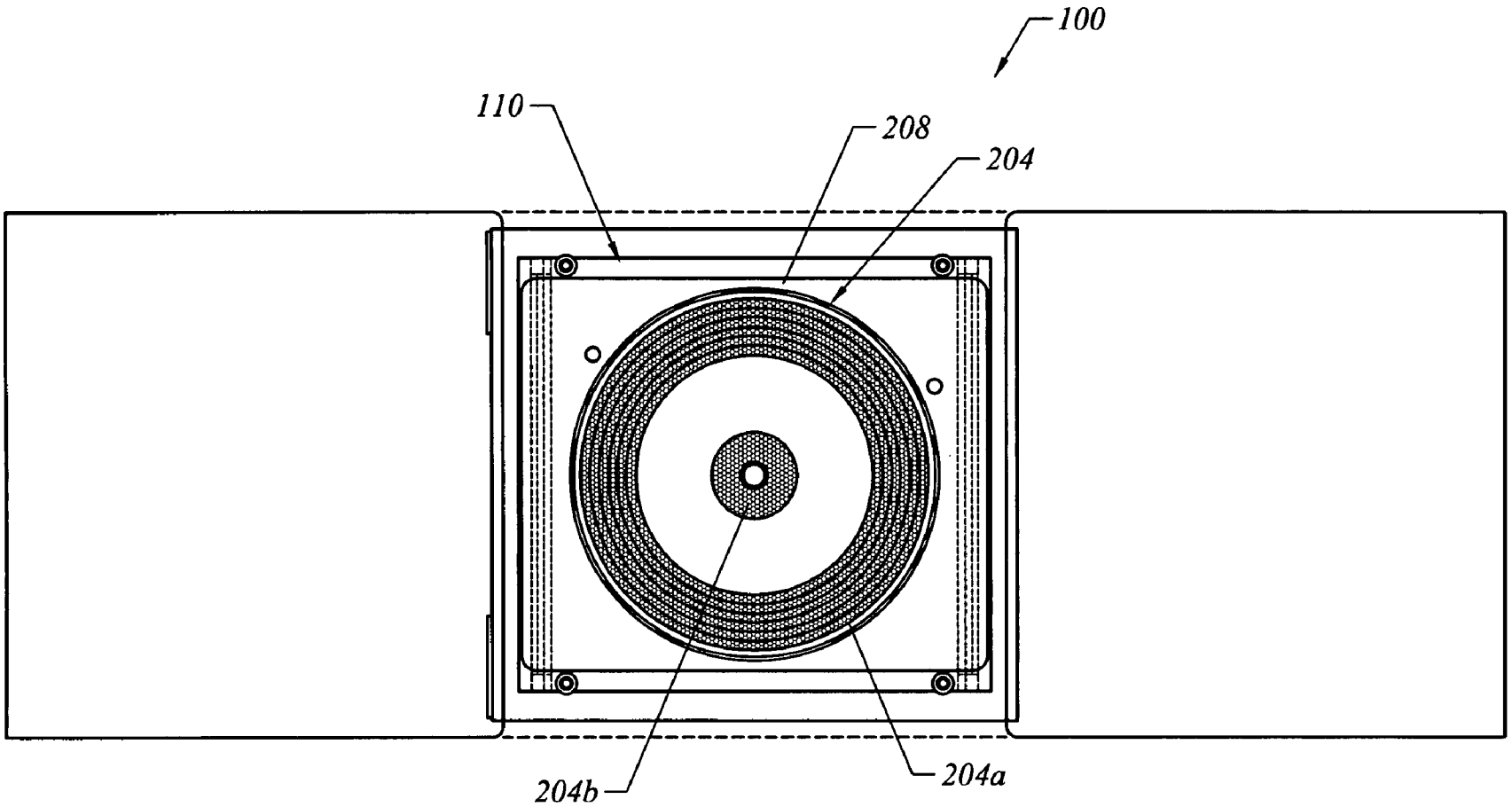
FIG. 2B shows illustrates an overhead view of the CMP system showing the platen in positional relationship to the polishing belt in accordance with one embodiment of the present invention.

FIG. 2B illustrates an overhead view of the CMP system 100 showing the platen 1110 in positional relationship to the polishing belt 102 in accordance with one embodiment of the present invention. In this embodiment, the platen 110 includes a platen plate 208 where an air pressure region 204 is located. The air pressure region 204 may emit air to generate an air bearing between the platen 110 and the polishing belt 102. The air bearing provides pressure on the underside of the polishing belt 102 during CMP operations. The air pressure region 204 may be one uniform pressure region or may include any number or configuration of air pressure subregions. In one embodiment, the air pressure region 204 includes a peripheral region 204*a* and a center region 204*b*. The peripheral region 204*a* is a circular area configured to provide air pressure to a portion of the polishing belt 102 that polishes an outer radial section of the wafer. A central region 204*b* is an area located near the center of the air pressure region 204 and has a smaller circumference than the peripheral region 204*a*. The central region 204*b* is configured to provide air pressure to a portion of the polishing belt 102 that polishes a center portion of the wafer. It should be appreciated that the platen 110 may be any size that would enable optimal wafer processing operations. In one embodiment, a circumference of the peripheral region 204*a* of the platen 110 is larger than the circumference of the wafer 104 being polished. Therefore, in this embodiment, the peripheral region 204*a* surrounds an area larger than the area occupied by the wafer 104. In this way, the platen 110 may better control polishing pressure of the leading edge 104*a* and the trailing edge 104*b* of the wafer 104. The configuration of the platen 110 with the air pressure region 204 is described in further detail in reference to FIGS. 3–5.

FIG. 3 shows a close-up overhead view of the platen 110 in accordance with one embodiment of the present invention. In this embodiment, the peripheral region 204*a* includes different annular subregions that include varying sizes of concentric air pressure regions. It should be appreciated that the peripheral region 204*a*, as well as the central region 204*b*, may have any number of subregions such as, for example, 2, 3, 4, 5, 6, 7, 8, 9, 10, etc. It should also be understood that the peripheral region 204*a* and the central region 204 may have any type of subregions such as, for example, circular subregions, seimicircular subregions, etc. In one embodiment, the peripheral region 204*a* has 6 subregions including annular subregions 204*a*-1, 204*a*-2, 204*a*-3, 204*a*-4, 204*a*-5, and 204*a*-6, and the central region 204*b* has one region with no subregions. Each of the subregions may be separately controlled so that the air flow rate through the separate subregions may be varied to optimize the CMP operation. By individually controlling the air flow rates through the separate subregions, variations in pressure can be generated at different diameters on the wafer. Thus, the plurality of subregions within the peripheral region 204*a* and the central region 204*b* therefore allow fine tuning of the pressure applied on different areas of the polishing belt 102. This pressure variation may be used to vary the polishing rates of different parts of a wafer because, as is well known in those skilled in the art, the amount of polishing that occurs on a portion of a wafer is a function of the pressure being applied on the corresponding portion of the belt. Therefore, more or less subregions may be utilized depending the polishing profile requirements. It should also be appreciated that none, one, or more air pressure subregions may have a larger circumference than a wafer being polished.

Figure 4:
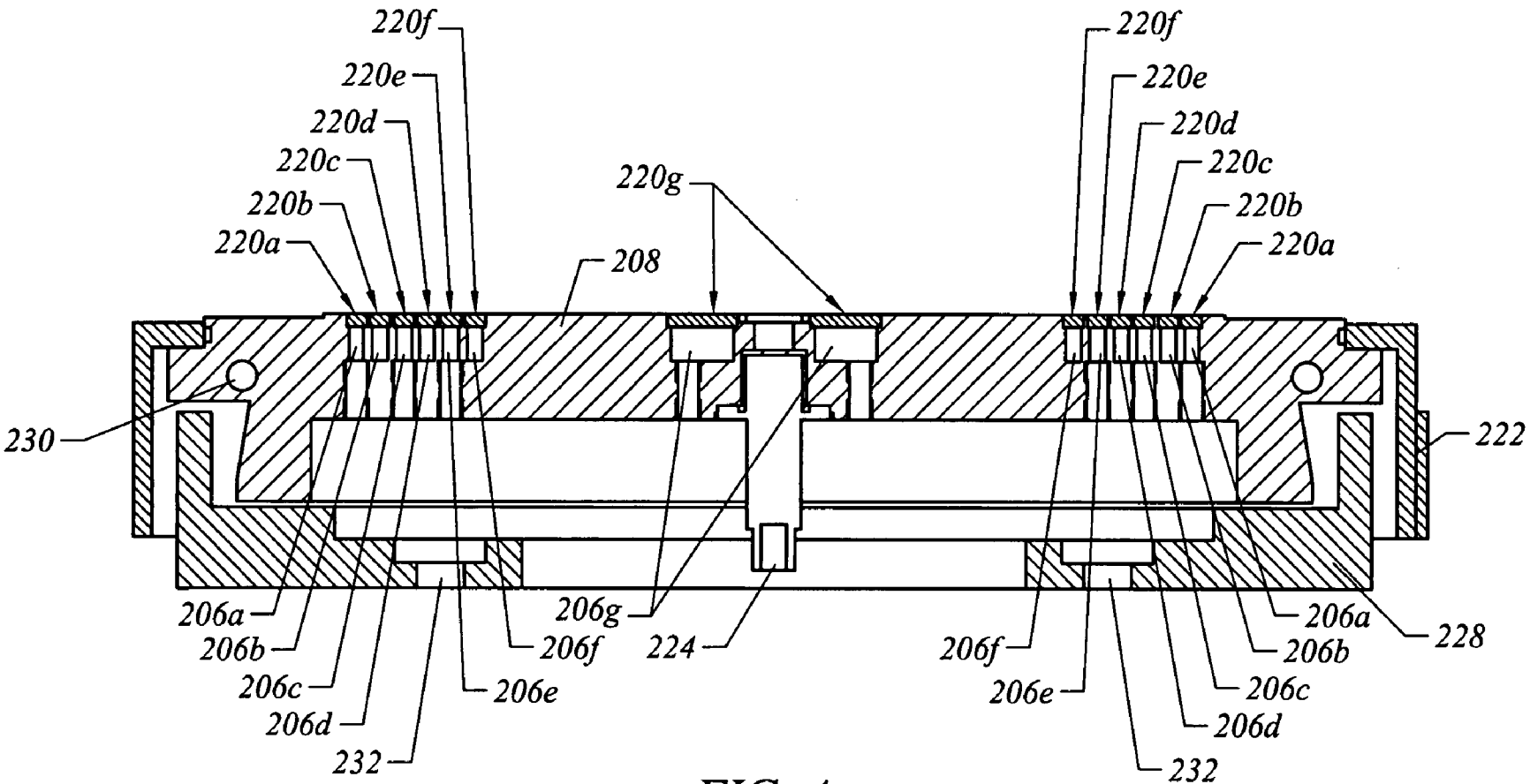
FIG. 4 shows a side view of a diametric slice of the platen as shown by FIG. 3 in accordance with one embodiment of the present invention.

FIG. 4 shows a side view of a diametric slice of the platen 102 as shown in FIG. 3 in accordance with one embodiment of the present invention. The platen includes a platen plate 208, mounting plate 228, and a platen cover 222. In this embodiment, annular recesses 206*a*, 206*b*, 206*c*, 206*d*, 206*e*, 206*f*, and 206*g* that are capable of outputting air are defined within the platen plate 208. It should be understood that any number or configuration of recesses that may output air can be utilized depending on the configuration and number of air pressure regions desired. For example, in another embodiment the recesses may be semicircular instead of annular, or in yet another embodiment, both annular and semicircular shaped recesses may be used. The annular recesses 206*a*, 206*b*, 206*c*, 206*d*, 206*e*, and 206*f* are configured to receive air from at least one air input port formed therein and to supply annular subregions 204*a*-1, 204*a*-2, 204*a*-3, 204*a*-4, 204*a*-5, and 204*a*-6 respectively with air so 6 distinct regions of air pressure may be created over the peripheral region 204*a*. The annular recess 206*g* is configured to supply air to a central portion of the platen so air pressure may be created over the central region 204*b*. The platen plate 208 may optionally include an end point detection hole 224 which may be utilized for CMP end point detection operations. In addition, an air/water pre-wet line 230 is defined to form circle through the inside of the platen plate. The air/water pre-wet line 230 may have an output to a surface of the platen plate 208. By injecting water through the line 230, the surface of the platen plate 208 may be wetted before commencing CMP operations.

The platen plate 208 is configured to be attached onto the mounting plate 228. The mounting plate 228 is configured to receive air from an air supply 114 (as shown in FIG. 2A) through mounting plate air inputs 232 and to provide the air to the annular recesses 206*a*, 206*b*, 206*c*, 206*d*, 206*e*, 206*f*, and 206*g* within the platen plate 208. The platen cover 222 may couple the outside edges of the platen plate 208 and the mounting plate 228 together to keep the platen plate 208 and the mounting plate 228 as a cohesive unit.

It should be appreciated that a plurality of annular sections may be disposed in a plurality of recesses. In one embodiment, annular sections 220*a*, 220*b*, 220*c*, 220*d*, 220*e*, 220*f*, and 220*g* of the porous material are disposed in the annular recesses 206*a*, 206*b*, 206*c*, 206*d*, 206*e*, 206*f*, and 206*g* respectively. The annular sections 220*a*, 220*b*, 220*c*, 220*d*, 220*e*, 220*f*, and 220*g* may be disposed in the recesses 206*a*, 206*b*, 206*c*, 206*d*, 206*e*, 206*f*, and 206*g* in any way that would ensure a secure structure. The annular sections 220*a*, 220*b*, 220*c*, 220*d*, 220*e*, 220*f*, and 220*g* may be made from any suitable material that can be formulated to have a porosity sufficient to restrict air flow therethreough so as to reduce an amount of air required for a CMP operation. Exemplary materials that can be formulated to have a porosity sufficient to provide the desired air flow for CMP operations include, for example, ceramic materials, aluminum-based materials, nickel-based materials (e.g., Inconel®), stainless steel, and titanium-based materials. For the air flow rates typically associated with CMP operations (e.g. between about 5 psi to about 90 psi), the porous materials may have a pore size of between about 10 microns to about 100 microns, and preferably between about 25 microns and about 45 microns. In one embodiment, the porous material has a pore size of about 35 microns. Those skilled in the art are familiar with suitable techniques for forming porous materials having a desired porosity and pore size.

Therefore, in operation, air is inputted through inputs 232 and channeled through the mounting plate 228 to air input ports feeding the annular recesses 206*a*, 206*b*, 206*c*, 206*d*, 206*e*, 206*f*, and 206*g*. The air pressure then forces air through the porous material that make up the annular sections 220*a*, 220*b*, 220*c*, 220*d*, 220*e*, 220*f*, and 220*g*. Because air movement is restricted through the porous material, the volume of air traveling through the platen 110 in a certain period of time is much less than with conventional platens. It is believed that the platen described herein will reduce air consumption as compared to conventional platens by at least one half. This enables generation of air pressure regions as described in FIG. 3 without using substantial amounts of air. By reducing air consumption, the cost of CMP operations may be significantly reduced.

Figure 5:
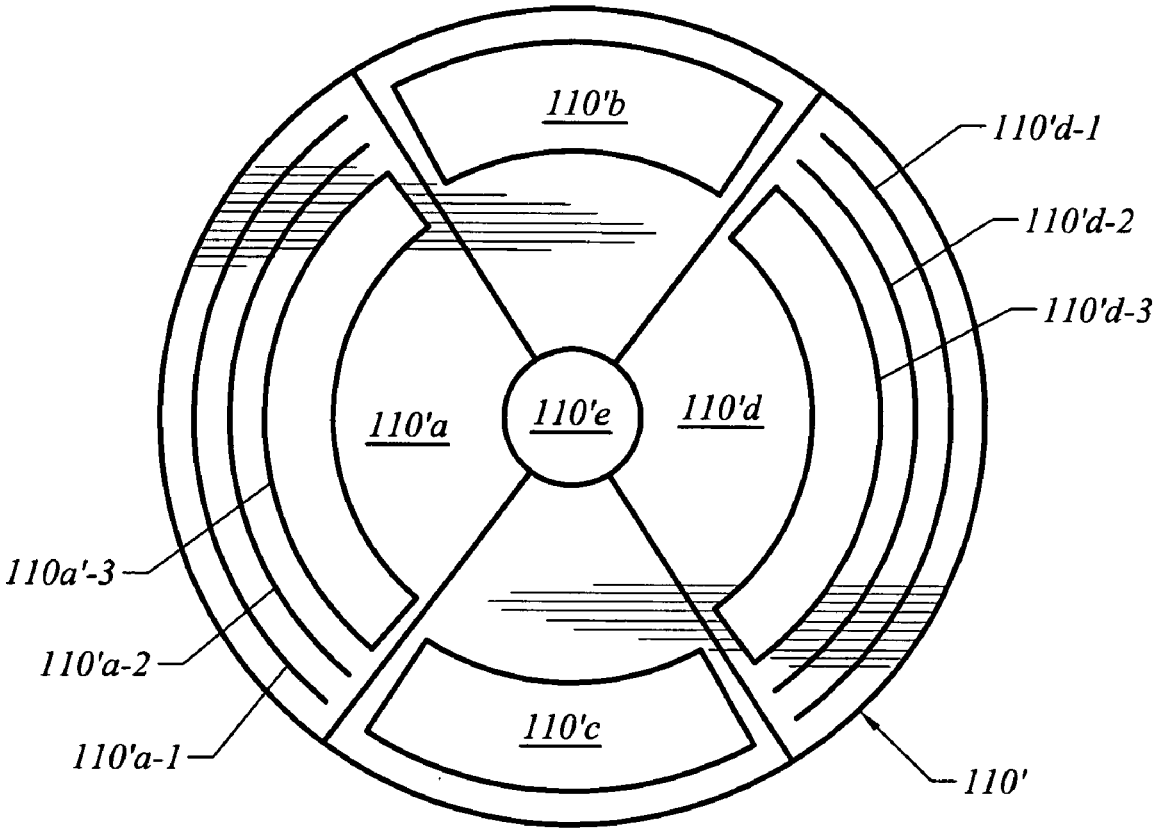
FIG. 5 shows a platen with an alternative air pressure region configuration in accordance with one embodiment of the present invention.

FIG. 5 shows a platen 110' with an alternative air pressure region configuration in accordance with one embodiment of the present invention. It should be understood that air outputs as described herein are recesses defined in the platen with the porous material as described in reference to FIG. 4. In this embodiment, the platen 110' is segregated into 4 major platen regions 110'*a*, 110'*b*, 110'*c*, 110'*d* controlling polishing pressure applied to 8 different parts of the wafer 104. The region 110'*b* includes 5 radial rows of a plurality of air outputs to control polishing pressure. The term radial rows as utilized herein are semicircular rows that are perpendicular to the radius from the center of the platen 110'. The region 110'*c* includes 5 radial rows of a plurality of air outputs. It should be understood that although the embodiments described herein do not separately control the regions 110'*b* and 110'*c*, the platen described herein may control each of the regions 110*a-d* separately. In one embodiment, each of the separately controllable regions such as the regions 110'*a-d* may be designed to communicate independent air flows through the separately controllable regions to the underside of the linear polishing pad to intelligently control polishing pressure. In another embodiment, the region 110'*a* and the region 110'*d* may be independently controlled and designed to output a controlled air flow.

The platen region 110'*a* includes three subregions each containing a plurality of air outputs. Subregion 110*a*'-1 and subregion 110*a*'-2 each includes one radial row of a plurality of air outputs while subregion 110*a*'-3 include 3 radial rows of a plurality of air outputs. By dividing the platen region 110'*a* into three subregions each containing a plurality of outputs, the platen region 110'*a* may intelligently, accurately, and precisely control polishing pressure on various portions of the wafer 104. In addition, because of the advantageous effects of applying more minute control of the outermost edges of the wafers, having single controllable radial rows of the subregions 110*a*'-1 and 110*a*'-2 enables more accurate management of polishing pressure to an area that may provide a significant planarization improvement while polishing in the area of pad deformities.

The platen region 110'd includes three subregions each containing a plurality of air outputs. Subregions 110'*d*-1 and 110'*d*-2 each includes one radial row of a plurality of air outputs while subregion 110'*d*-3 may include 3 radial rows of a plurality of air outputs. The three subregions 110'*d*-1, 110'*d*-2, and 110'*d*-3 each contains air outputs which enables the platen region 110*d* to intelligently and accurately control polishing pressure on various portions of the wafer 104. Furthermore, having single controllable radial rows of the subregions 110*a*' and 110*a*" enables more accurate management of polishing pressure on the trailing edge of the wafer 104 which, due to polishing pad deformities, may require a higher control of polishing pressure management. All of the subregions within the regions 110'*a*, 110'*b*, 110'*c*, and 110'*d* include air outputs to enable reduced air consumption during wafer processing.

A center region 110'*e* containing a circular plurality of air outputs may also be utilized to control the polishing pressures and the resulting polishing dynamics of the wafer 104. The center region 1110'*e* includes the circular plurality of air to substantially reduce air use during CMP operations. Consequently, the platen with the porous materials may control air pressure and the resultant polishing pressure by varying and adjusting air pressure in any, some, or all of the regions and subregions of the platen while using much less air than conventional apparatuses.

The invention has been described herein in terms of several exemplary embodiments. Other embodiments of the invention will be apparent to those skilled in the art from consideration of the specification and practice of the invention. For example, the entire platen may be made from the porous material. The embodiments and preferred features described above should be considered exemplary, with the invention being defined by the appended claims.

What is claimed is:

1. A platen for use in chemical mechanical planarization (CMP) systems, comprising:

a platen plate having at least one recess defined therein, the at least one recess having an input port formed therein; and a porous material disposed in the at least one recess, the porous material having a porosity sufficient to restrict air flow therethrough, the platen plate having the porous material being configured for positioning proximate to a surface of a polishing pad during a CMP operation.

2. A platen for use in chemical mechanical planarization (CMP) systems as recited in claim 1, wherein the porous material is comprised of one of a ceramic material, an aluminum-based material, stainless steel, a nickel-based material, and a titanium-based material.

3. A platen for use in chemical mechanical planarization (CMP) systems as recited in claim 1, wherein the porous material has a pore size of between about 10 microns and about 100 microns.

4. A platen for use in chemical mechanical planarization (CMP) systems as recited in claim 1, wherein the porous material has a pore size of between about 25 microns and about 45 microns.

5. A platen for use in chemical mechanical planarization (CMP) systems as recited in claim 1, wherein the recess defined in the platen has an annular shape.

6. A platen for use in chemical mechanical planarization (CMP) systems as recited in claim 5, wherein the porous material has an annular shape that is configured to be received in the annular shaped recess.

7. A platen for use in chemical mechanical planarization (CMP) systems, comprising:

a platen plate having at least one recess defined therein, the at least one recess having an input port formed therein, wherein the at least one recess includes a single recess defined in a central region of the platen plate or one of a plurality of recesses is defined in a peripheral region of the platen plate; and a porous material disposed in the at least one recess, the porous material having a porosity sufficient to restrict air flow therethrough, the platen plate having the porous material being configured for positioning proximate to a surface of a polishing pad during a CMP operation.

8. A platen for use in chemical mechanical planarization (CMP) systems as recited in claim 7, wherein the porous material is comprised of one of a ceramic material, an aluminum-based material, stainless steel, a nickel-based material, and a titanium-based material.

9. A platen for use in chemical mechanical planarization (CMP) systems as recited in claim 7, wherein the porous material has a pore size of between about 10 microns and about 100 microns.

10. A platen for use in chemical mechanical planarization (CMP) systems as recited in claim 7, wherein the porous material has a pore size of between about 25 microns and about 45 microns.

11. A platen for use in chemical mechanical planarization (CMP) systems as recited in claim 7, wherein the recess defined in the platen has an annular shape.

12. A platen for use in chemical mechanical planarization (CMP) systems as recited in claim 11, wherein the porous material has an annular shape that is configured to be received in the annular shaped recess.

13. A platen for use in chemical mechanical planarization (CMP) systems, comprising:

a platen plate having at least one recess defined therein, the at least one recess having an input port formed therein, wherein a plurality of recesses is defined in a peripheral region of the platen plate, the plurality of recesses including six recesses, each of the six recesses having an input port formed therein; and a porous material disposed in the at least one recess, the porous material having a porosity sufficient to restrict air flow therethrough so as to reduce an amount of air required for a CMP operation.

14. A platen for use in chemical mechanical planarization (CMP) systems, comprising:

a platen plate having a recess defined in a central region of the platen plate and a plurality of recesses defined in a peripheral region of the platen plate, the recess in the central region and each of the plurality of recesses defined in the peripheral region having an input port therein, the recess defined in the central region and each of the plurality of recesses defined in the peripheral region having an annular shape; and a plurality of annular sections, one of the annular sections being disposed in the recess defined in the central region of the platen plate and the other of the annular sections being disposed in the plurality of recesses defined in the peripheral region of the platen plate, each of the plurality of annular sections being comprised of porous material having a porosity sufficient to restrict air flow therethrough so as to reduce an amount of air required for a CMP operation.

15. A platen for use in chemical mechanical planarization (CMP) systems as recited in claim 14, further comprising:

a mounting plate coupled to a bottom portion of the platen plate, the mounting plate being configured to transport air from an air input at a bottom portion of the mounting plate to an input port in the recess defined in the central region and to an input port in each of the plurality of recesses defined in the peripheral region.

16. A platen for use in chemical mechanical planarization (CMP) systems as recited in claim 14, wherein the porous material is comprised of one of a ceramic material, an aluminum-based material, a nickel-based material, stainless steel, and a titanium-based material.

17. A platen for use in chemical mechanical planarization (CMP) systems as recited in claim 14, wherein the porous material has a pore size of between about 10 microns and about 100 microns.

18. A platen for use in chemical mechanical planarization (CMP) systems as recited in claim 14, wherein the porous material has a pore size of between about 25 microns and about 45 microns.

19. A platen for use in chemical mechanical planarization (CMP) systems as recited in claim 14, wherein the plurality of recesses in the peripheral region of the platen plate includes six recesses, each of the six recesses having an input port.

20. A platen for use in chemical mechanical planarization (CMP) systems, comprising:

a platen plate having at least one recess defined therein, the at least one recess having an input port formed therein; and a porous material disposed in the at least one recess, the porous material having a porosity sufficient to restrict air flow therethrough, the platen plate having the porous material being configured for positioning proximate to a surface of a polishing pad during a CMP operation.

21. A platen for use in chemical mechanical planarization (CMP) systems, comprising:

a platen plate having at least one recess defined therein, the at least one recess having an input port formed therein;

a porous material disposed in the at least one recess;

a single recess defined in a near central region of the platen plate; and a plurality of recesses defined in a peripheral region of the platen plate.

* * * * *